United States Patent [19]

Lee

[11] Patent Number: 4,654,982

[45] Date of Patent: Apr. 7, 1987

[54] TOE VENTILATING PNEUMATIC SHOES

[76] Inventor: Kuyn C. Lee, Room 405, Taepyung Yang Apt. 6, 1774-1, DaeYun 6 Dong, Namku, Pusan, Rep. of Korea

[21] Appl. No.: 853,462

[22] Filed: Apr. 18, 1986

[30] Foreign Application Priority Data

Apr. 18, 1985 [KR] Rep. of Korea ..... 1985-4450

[51] Int. Cl.[4] ..... A43B 7/06; A43B 13/20; A43B 13/41

[52] U.S. Cl. ..... 36/3 R; 36/3 B; 36/29; 36/44

[58] Field of Search ..... 36/3 R, 3 B, 29, 43, 36/44

[56] References Cited

U.S. PATENT DOCUMENTS

| | | | |
|---|---|---|---|
| 2,668,372 | 2/1954 | Wright | 36/3 R |
| 4,063,371 | 12/1977 | Batra | 36/3 B |
| 4,438,573 | 3/1984 | McBarron | 36/3 B |

FOREIGN PATENT DOCUMENTS

| | | | |
|---|---|---|---|
| 3228017 | 7/1983 | Fed. Rep. of Germany | 36/3 R |
| 930 | of 1896 | United Kingdom | 36/3 B |

*Primary Examiner*—James Kee Chi

*Attorney, Agent, or Firm*—Brezina & Buckingham

[57] ABSTRACT

The invention relates to a ventilated shoe device utilizing air passageways and spring loaded valves to promote positive airflow resulting from compression of the sole elements, thereby providing increased hygiene and comfort, and further providing case of cleaning of the shoes through access covers.

2 Claims, 8 Drawing Figures

TOE VENTILATING PNEUMATIC SHOES

BRIEF SUMMARY OF THE INVENTION

Conventionally, for the circulation of sweat and humid air created inside of shoes when worn, the shoes are generally provide holes for ventilation on the upper of the shoes; by providing air-induction holes through to the outer sole, or by providing a space with the installation of an air-exhaust exit so as to circulate the inner air up to the outer-sole. However, these methods involve a difficulty of manufacturing because of the structural complexity. In addition there were defects noted in the losing of ventilation due to the malfunction of the air-exhausting device installed after a long use.

In order to resolve such defects, this invention utilizes a number of holes concentrated at the front portion of the shoes sole which are interconnected around the toes, which portion of the shoe is subject to odor and promotion of athlete's foot in the shoe. In conjunction with the bored holes, the rear portion and side portion of the shoe are provided with air passage ways connecting the holes to the air-way which passes through to the outside, smoothly exhausting the air created around the front of the toes while wearing the shoes. This can always keep the shoe in dryer condition, with removal of odor and prevention of athlete's foot. This apparatus is further explained in the following Detailed Description of the Drawings.

DETAILED DESCRIPTION OF THE DRAWING

Figure 1:
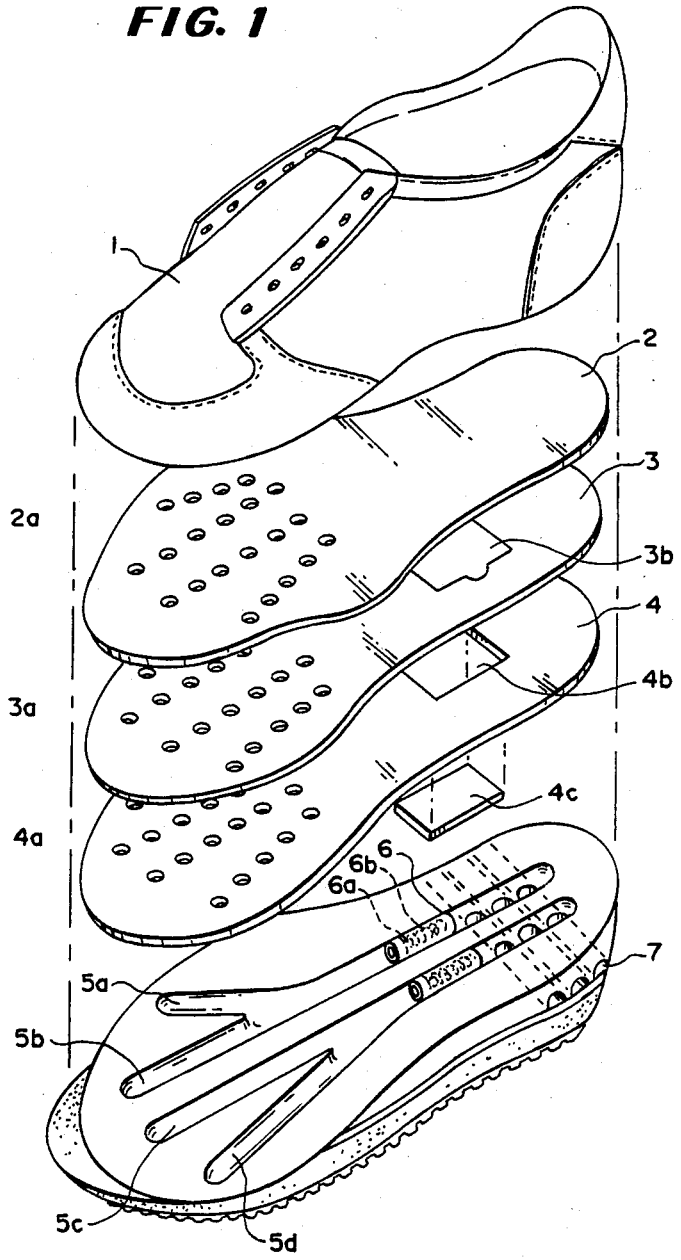
FIG. 1 is a perspective view of this device.

The invention utilizes a unitary upper-sole structure which is of bonded construction and is constituted of a cushion (3), a mid-sole (4), and an out-sole (5), by bonding them to the inside of the upper of leather or synthetic fabric shoes. The shoe is then removably fitted with an in-sole (2) with an arch support. After the bonding operation, the unitary structure has a series of holes of (2*a*) (3*a*) (4*a*) bored through the combined sole portion and dispersed around that portion aligned in three linear groups toward the toes of the in-sole, cushion, mid-sole structure. These holes correspond with holes in the removably fitted In-sole.

A lid-portion (3*b*) is removably fitted at the cushion (3) sole near its heel portion. This corresponds to a square hole portion (4*b*) of the mid-sole (4) which has a removably fitted sponge cover (4*c*) carried in removable relation to it.

The out-sole has a pair of branched airways (5*a*) (5*b*) (5*c*) (5*d*) which are aligned with the holes in the unitary upper-sole structure as explained herein.

Air-expiration exhausters (6) consisting of balls (6*a*) and springs (6*b*) are fitted in the airways at each middle portion slightly to the rear therefore the airway are then connected with exhaust holes (7) (8) bored laterally at the side and rear portion of the outer sole. In an alternative embodiment as in a boot or high-top shoe they may be connected with exhaust-way (10) formed in elastomeric pipe (9) extending to the top of the shoe or boot.

Figure 2A:
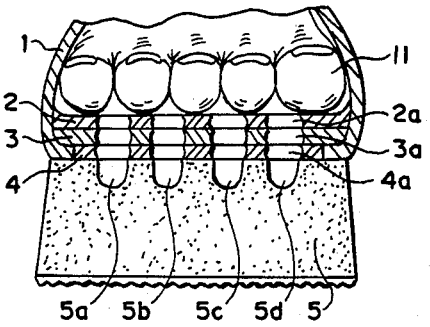
FIG. 2 is a sectional view of this device. (A) is a front-portion of a vertical section. (B) is a rear-portion of a vertical section. (C) is a rear-portion of a cross sectional-view. (D) is a exhaust exit for air in the middle portion of a sectional views.
Figure 2B:
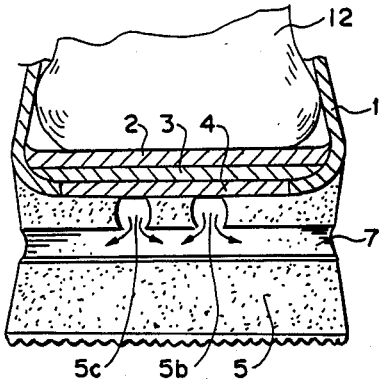
Figure 2C:
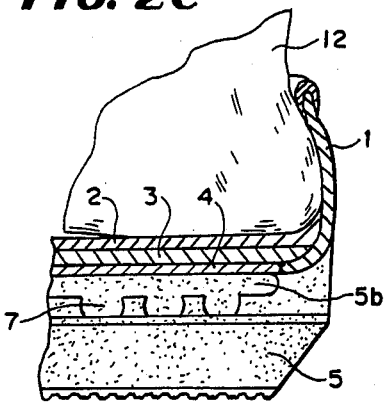
Figure 2D:
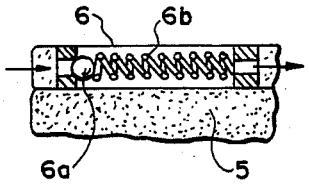

In FIGS. 2(A) through 2(C) numeral "11" represents toes and "12" represents a foot.

The above mentioned device is fitted and used for various shoes, and when shoe's sole components cushion and leather or fabric upper, are assembled, the hole (2*a*) of the in-sole, the hole (3*a*) of cushion (3), hole (4*a*) of the mid-sole (4) and airway (5*a*) (5*b*) (5*c*) (5*d*) of the out-sole (5) are aligned as shown in representation (A) of FIG. 2.

Figure 3A:
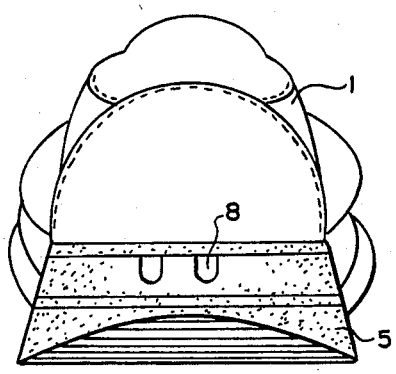
FIG. 3 (A) is a rear-view of the ventilation holes at the rear portion of the outside sole. (B) is a vertical section of A.
Figure 3B:
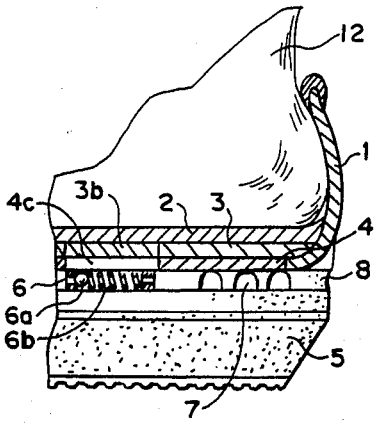

The holes in the sole-upper structure are to be concentrated in the toe (11) portion where a high growth rate of athlete's foot is manifest. Accordingly the exhaust-air is drawn mostly from the front portion of the shoes' in-sole while wearing the shoes and is exhausted outside through the series of holes and airways. The air inside the shoe's sole is exhausted through the holes by the compressing force of the foot (12) on the elastomeric sole elements while wearing the shoes. The air is introduced to the airway (5*a*) (5*b*) (5*c*) (5*d*) of the out-sole passage through the series of holes and because of pressure created by the decreasing volume of the air passages as the sole elements are compressed passes the ball (6*a*) of the air-exhauster (6) inserted at each middle portion of the respective airways (as shown at Representation (D) of FIG. 2) and compresses the springs (6*b*) and then escapes in the direction of the arrow and is then exhausted outside through the exhaust-hole of (7) (8) bored at the side and rear portion of the out-sole and connected to the airway as shown in Representation (C) of FIG. 2 and (B) of FIG. 3. Due to the circulation and exhaustion of humid air which would normally remain around the sole, athlete's foot which would normally be created between the toes could be prevented completely, sweat would be evaporated and comfort greatly improved.

The motive force for operation of the device is provided by the footstrike and lifting of the foot and the weight of the wearer compressing the cushion and other elements of the sole. The compression compresses the trapped air against the spring pressure, forcing air through the airways.

Spring (6*a*) of the air-exhauster then exerts rebound elasticity at the moment of lifting of the foot, and replaces the ball to its previous position. The cycle is repeated with each footstrike-lifting of each respective foot.

As previously mentioned, another important feature of the instant invention is the end of opening for cleaning and replacement of the airways and air exhausters. In order to wash the shoes, the first step is to pull out the in-sole (2). Next one opens the lid (3*b*) of the cushion (3), and removes the sponge cover (4*c*) previously inserted into the square hole (4*b*) of the mid-sole (4). Next one must extract the air-exhauster (6). Finally one washes and dries each of the components. The configuration permits one to quickly dry the moisture in the airway and reassemble the components. This configuration also permits ease in exchanging the air-exhauster for new or repaired parts should it deteriorate or break.

Figure 4:
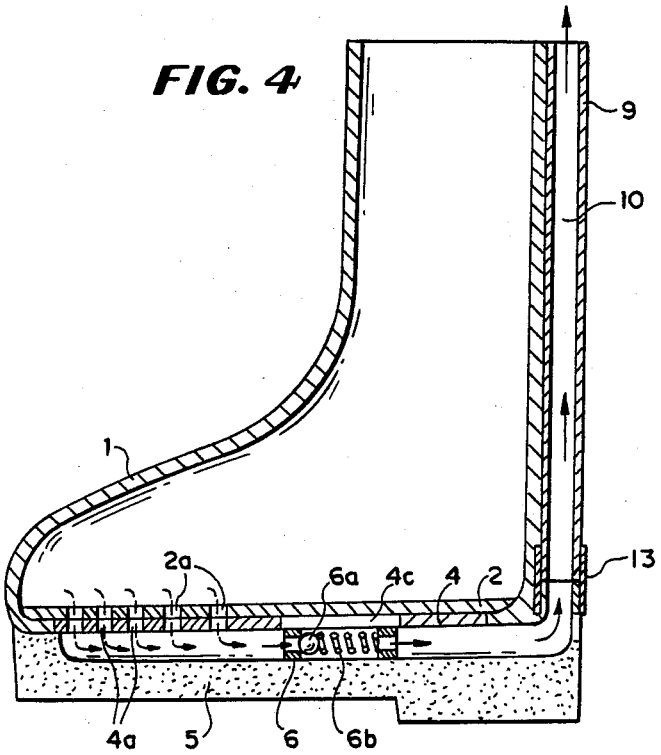
FIG. 4 is a sectional view applied to boots with the essential portion of this device.

In FIG. 4, is an alternative embodiment of this invention as may be applied in the case of high top shoes or boots. The main air flow continues to be induced in the airway (5*b*) through the holes (2*a*) (4*a*) and flows through the air way. In this embodiment it passes through the exhaust-way (10) and exhausts upwardly, after passing through the exhauster (6), through an elastomeric pipe (9). In this way, this embodiment can realize the purpose of the complete extraction of inner air without exhaust channels exposed to environmental conditions, particularly in situations where waterproof boots are likely to be worn. This invention prevents an unpleasant smell and development of athlete's foot of toe portion by maintaining a dry condition, and provides for more comfort while wearing the shoes.

I claim:

1. A shoe ventilation apparatus providing ventilation while the shoe is worn, comprising:

flexible, cushion, mid-sole and uppers bonded together and to an out-sole;

said bonded combination removably fitted with an in-sole;

said out-sole providing branching air-channel means, and air exhaust channel means open to ambient air;

said air-channel means corresponding to a series of corresponding air passages means bored through said in-sole, cushion and uppers;

said air passage means providing egress for air from the interior of said shoe;

said air channel means removably fitted with air-exhausting means at their junction with said air exhaust channel means;

in which said cushion means are composed of an elastomeric, gas impermeable foam, and said out-sole means are composed of an elastomeric, gas impermeable material;

and in which said mid-sole and cushion means have air-exhauster access ports therein, said ports having removable cover means fitted therein;

and in whch said air exhaust channel means are perpendicular to said air channel means.

2. A shoe ventilation apparatus providing ventilation while high top shoes or boots are worn, comprising:

flexible, cushion and uppers bonded together and to an out-sole;

said bonded combination removably fitted with an in-sole;

said out-sole providing branching air-channel means, and air exhaust channel means open to ambient air;

said air-channel means corresponding to a series of corresponding air passages means bored through said in-sole, cushion and uppers;

said air passage means providing egress for air from the interior of said shoe;

said air channel means removably fitted with air-exhausting means at their junction with said air exhaust channel means;

in which said cushion means are composed of an elastomeric, gas impermeable foam, and said out-sole means are composed of an elastomeric, gas impermeable material;

and in which said cushion means have air-exhauster access ports therein, said port having removable cover means fitted therein;

and in whch said air exhaust channel means are perpendicular to said air channel means and extending vertically therefrom along the extended portion of the shoe upper.

* * * * *